US008794702B2

(12) United States Patent
Brown et al.

(10) Patent No.: US 8,794,702 B2
(45) Date of Patent: Aug. 5, 2014

(54) ROTATING SEAT

(75) Inventors: Patrick W. Brown, Auburn, OH (US); John R. Nottingham, Bratenahl, OH (US); John W. Spirk, Gates Mills, OH (US); Robert F. Soreo, Cleveland Heights, OH (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 435 days.

(21) Appl. No.: 13/076,342

(22) Filed: Mar. 30, 2011

(65) Prior Publication Data

US 2011/0241398 A1 Oct. 6, 2011

Related U.S. Application Data

(60) Provisional application No. 61/319,069, filed on Mar. 30, 2010.

(51) Int. Cl.
*A63G 9/00* (2006.01)
*A63G 9/16* (2006.01)

(52) U.S. Cl.
CPC ... *A63G 9/16* (2013.01); *A63G 9/00* (2013.01)
USPC ..... 297/273; 472/121

(58) Field of Classification Search
CPC ..... A63G 9/16; A63G 9/00; A47D 13/105
USPC ..... 297/183.9, 273, 344.21; 472/118, 120, 472/121, 14
See application file for complete search history.

(56) References Cited

U.S. PATENT DOCUMENTS 2,532,444 A * 12/1950 Carmel ..... 472/118
3,294,196 A * 12/1966 Rabelos ..... 182/100
3,873,087 A 3/1975 Burkart et al.
4,296,923 A * 10/1981 Ahrens ..... 472/118
4,896,878 A 1/1990 Greenwood
6,342,013 B1 * 1/2002 Irelan ..... 472/14
6,494,787 B1 * 12/2002 Bork et al. ..... 472/16
2006/0128481 A1 6/2006 Ballin

FOREIGN PATENT DOCUMENTS

CA 2457592 A1 6/2004
KR 20000007349 A 2/2000

OTHER PUBLICATIONS

PCT Search Report and Written Opinion from PCT Application No. PCT/US2011/030602 entitled Rotating Seat (Dated Dec. 9, 2011).

* cited by examiner

*Primary Examiner* — Milton Nelson, Jr.
(74) *Attorney, Agent, or Firm* — Hovey Williams LLP

(57) ABSTRACT

A rotating seat for suspension from a play set structure includes a seat body rotatable about a generally vertical axis with an upper seating surface configured to support a user, an elongated suspending element configured to support the seat body from the play set structure, and a handle assembly operably coupled with the suspending element to cause rotation of the seat body relative to the axis upon actuation by the user. The suspending element extends substantially vertically, presents opposite upper and lower end margins, is configured to operably couple with the play set structure along the upper end margin, and is operably coupled with the seat body at a location spaced from the upper end margin. A damped pivot connection assembly configured to operably secure the suspending element with the play set structure and allow restrained pivoting movement of the suspending element relative to a fixed bracket of the connection assembly is also disclosed.

17 Claims, 12 Drawing Sheets

ROTATING SEAT

CROSS-REFERENCE TO RELATED APPLICATION

The present application claims the benefit of and priority from U.S. Provisional Patent Application Ser. No. 61/319,069, filed Mar. 30, 2010, the entire disclosure of which is hereby incorporated by reference herein.

BACKGROUND OF THE INVENTION

1. Field of the Invention

The present invention relates generally to a rotating seat for suspension from a play set structure. More specifically, the present invention concerns a rotating seat that includes a seat body rotatable about a generally vertical axis with an upper seating surface configured to support a user, an elongated suspending element configured to support the seat body from suitable structure, and a handle assembly operably coupled with the suspending element to cause rotation of the seat body relative to the axis upon actuation by the user.

2. Discussion of the Prior Art

Those of ordinary skill in the art will appreciate that conventional play sets typically include a frame or other support structure, and a number of known play accessories (e.g., swings, slides, climbing walls, etc.) supported on or suspended from the support structure. A distinct category of recreational devices, play accessories that are designed to stand alone, are known in the art to require dedicated ground space upon which to be placed. For example, conventional rotating devices (e.g., carousels, merry-go-rounds, etc.) have been separate from any other play set structure and have required placement on level ground, most commonly a hard surface, where injury may occur if a user falls off of the rotating device.

SUMMARY

The present invention provides a rotating seat for suspension from a play set structure or other suitable structure, including a rotatable seat body coupled with an elongated suspending element. A handle assembly is operably coupled with the suspending element to allow a user to selectively cause rotation of the seat body upon actuation thereof.

More particularly, according to one aspect of the present invention, a rotating seat is provided for suspension from a play set structure. The rotating seat includes a seat body with an upper seating surface configured to support a user. The seat body is rotatable about a generally vertical axis of rotation. The rotating seat also includes an elongated suspending element configured to support the seat body from the play set structure. The suspending element extends substantially vertically and presents opposite upper and lower end margins. The suspending element is configured to operably couple with the play set structure along the upper end margin, and is operably coupled with the seat body at a location spaced from the upper end margin. The rotating seat further includes a handle assembly operably coupled with the suspending element and configured to cause rotation of the seat body relative to the axis upon actuation thereof.

Embodiments of the present invention may also include a damped pivot connection assembly for securing the suspending element to the play set structure and allowing restrained pivoting movement of the suspending element relative to a fixed bracket of the connection assembly. It is believed that the damped pivot connection may, among other things, prevent bending or other damage to a rigid suspending element during repeated use of the rotating seat.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein.

Figure 1:
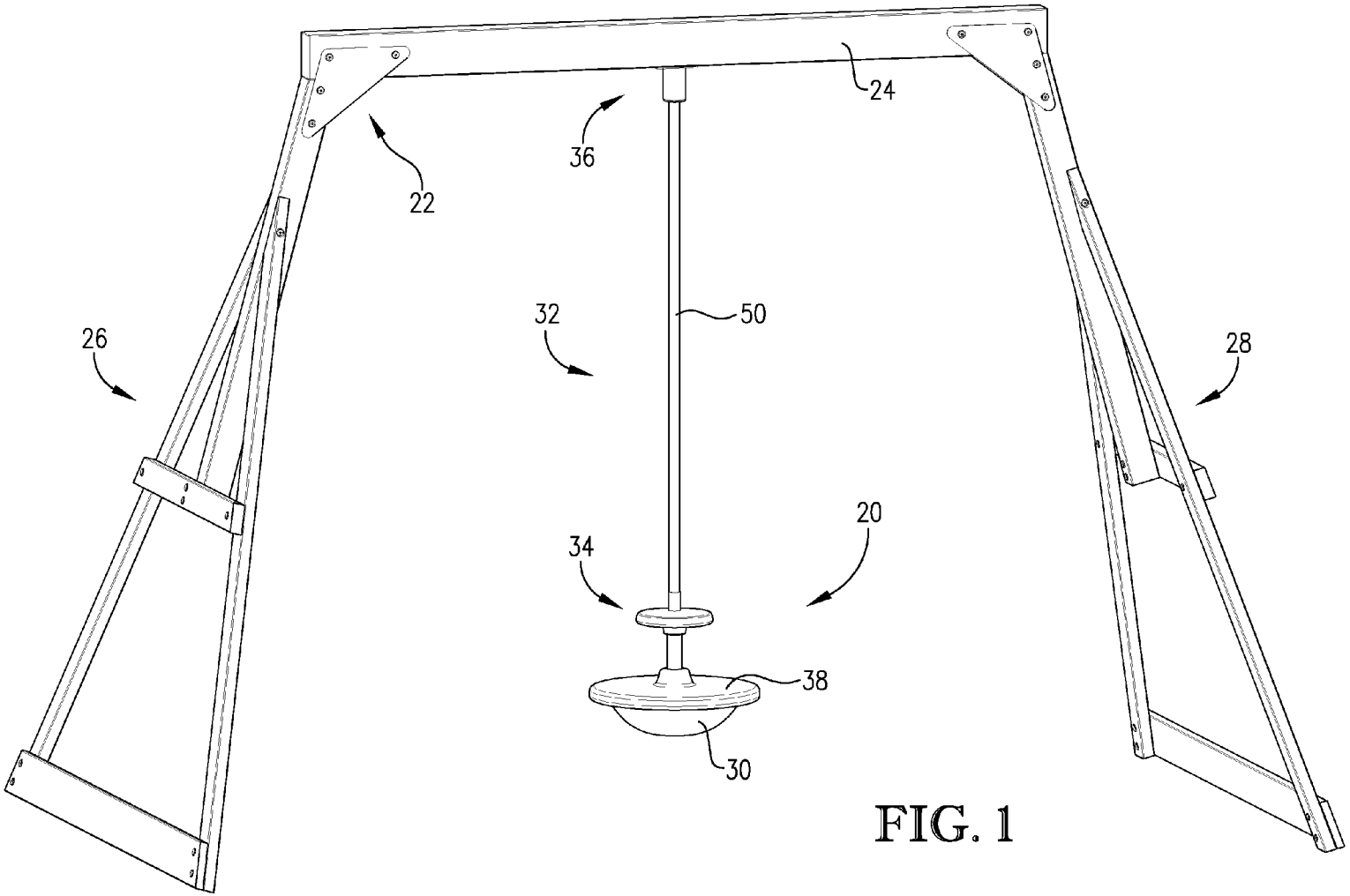
FIG. 1 is an isometric view of a rotating seat constructed in accordance with the principles of an embodiment of the present invention including a rotatable seat body and a handle assembly fixed relative to a suspending element, the rotating seat shown with and secured to a typical play set structure.
Figure 2:
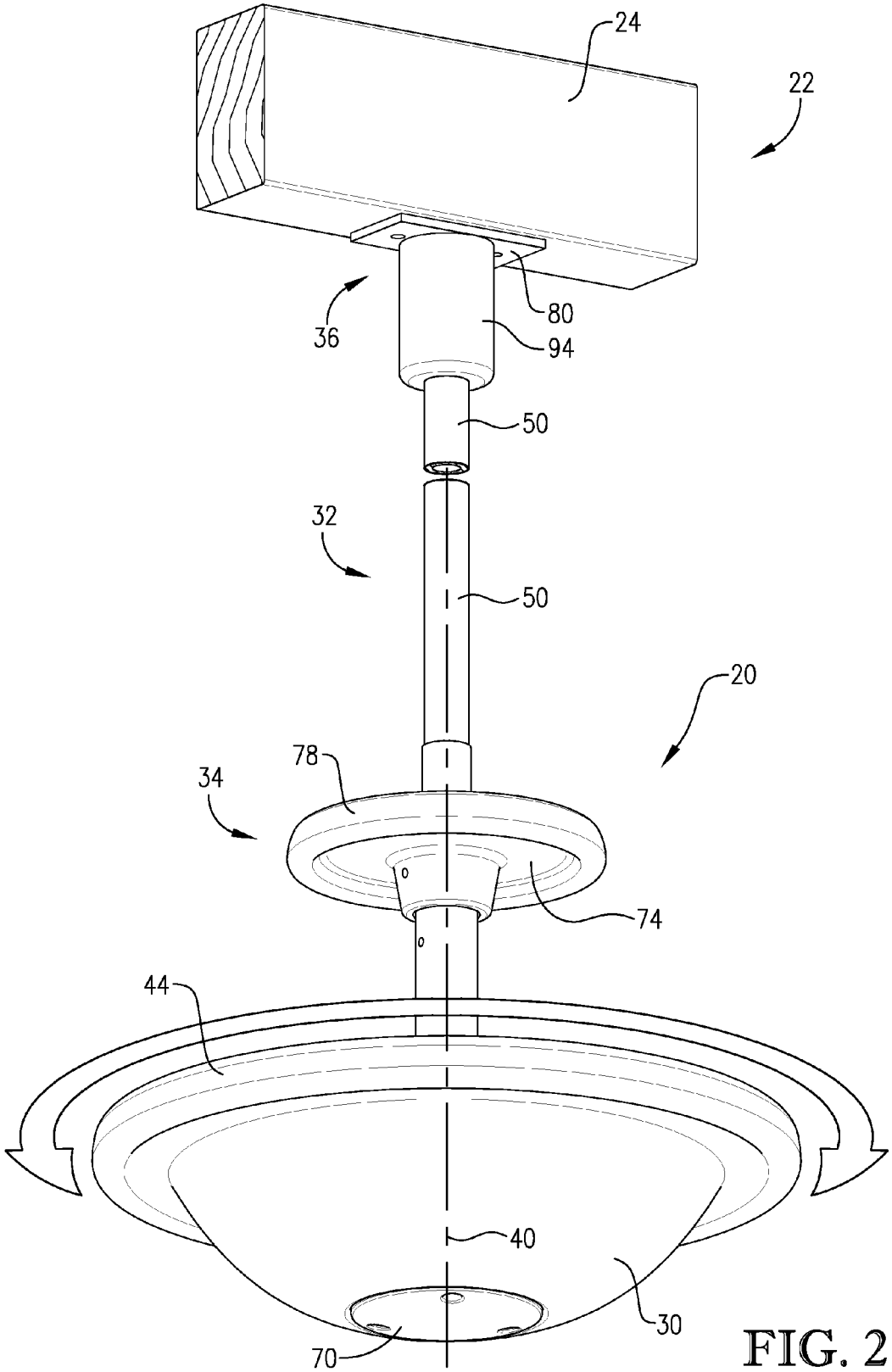
FIG. 2 is an enlarged, partial fragmentary, isometric view of the rotating seat shown in FIG. 1, particularly illustrating the rotating motion of the seat body relative to a generally vertical axis of rotation.
Figure 3:
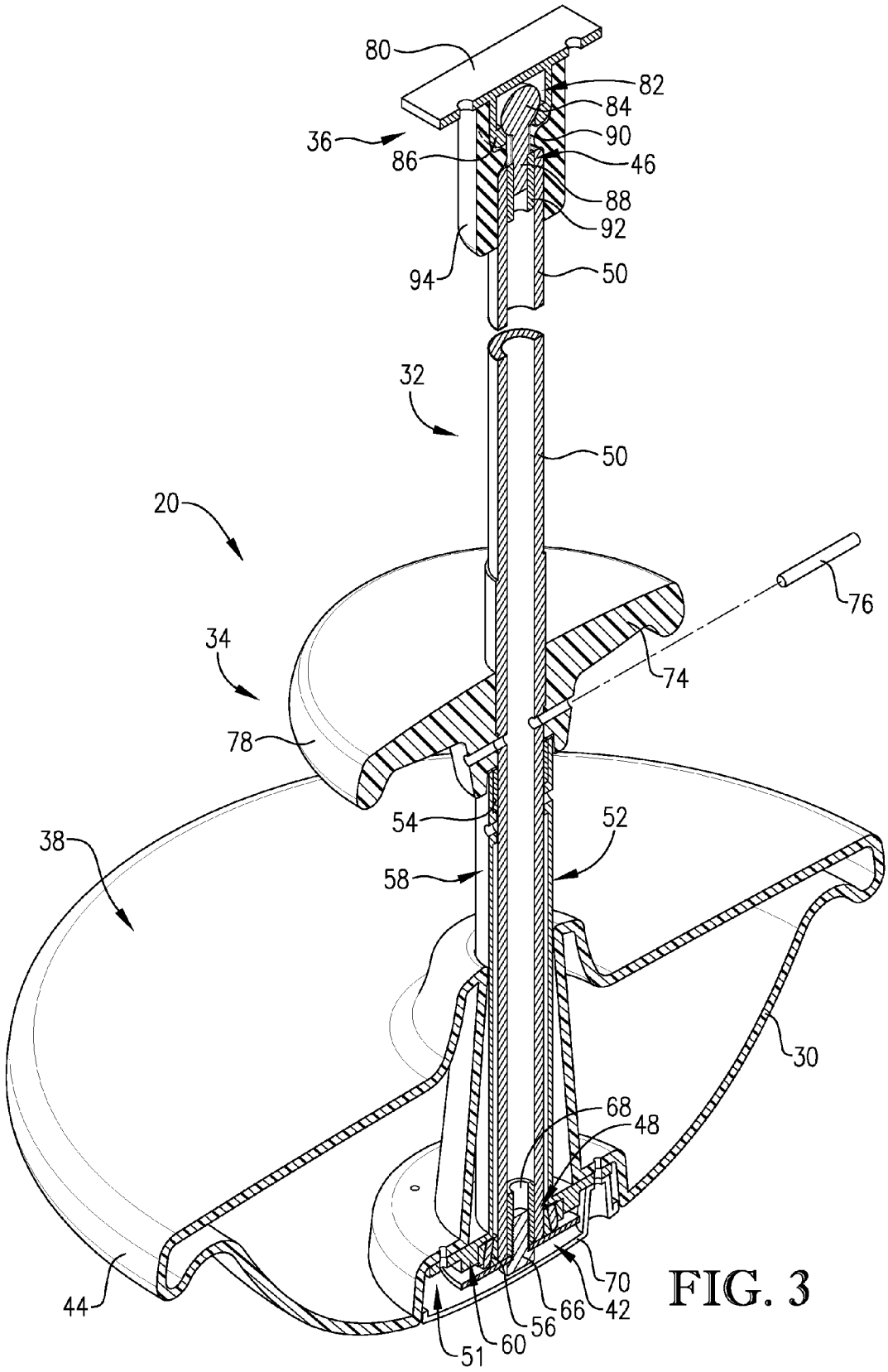
Figure 4:
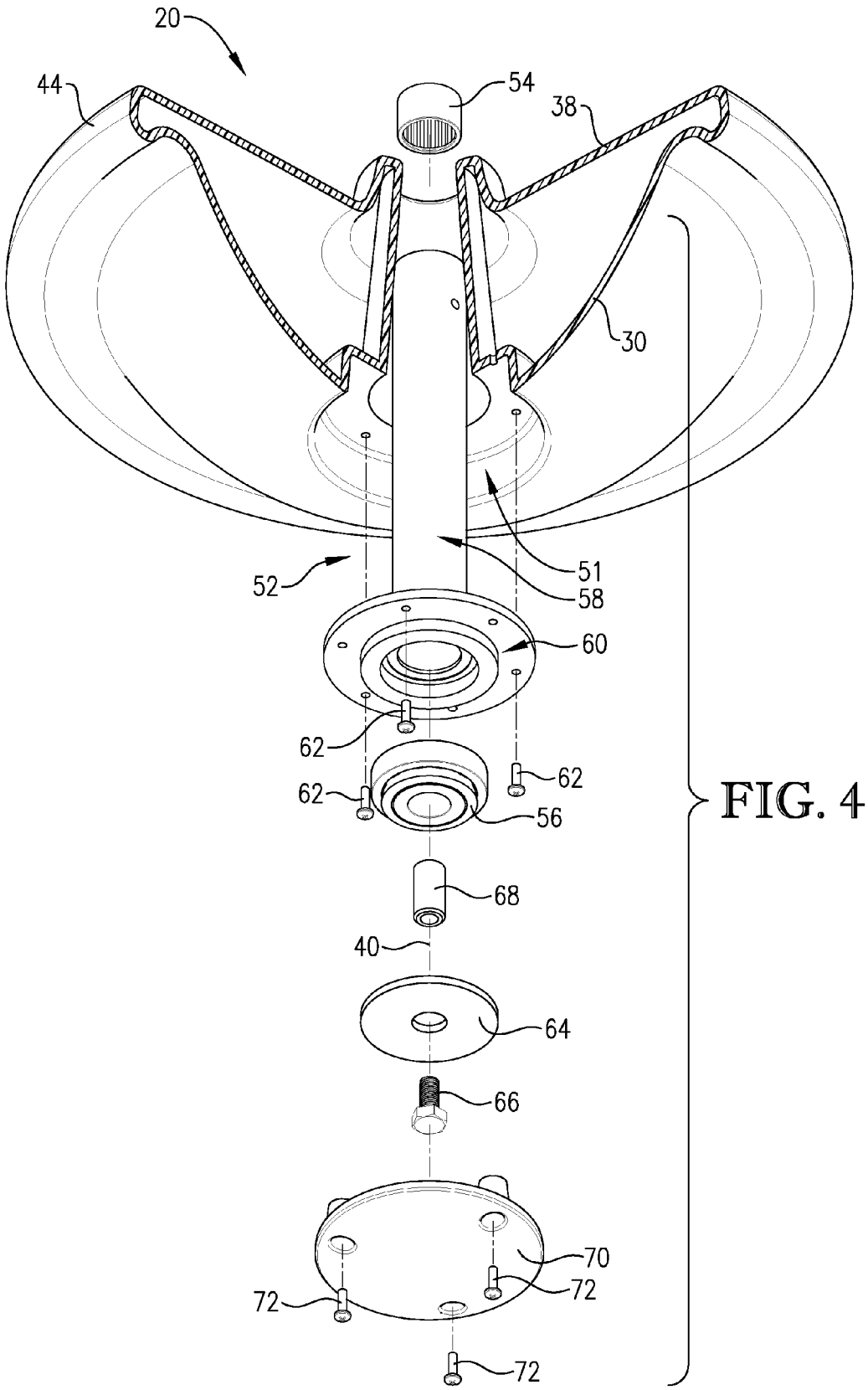
Figure 5A:
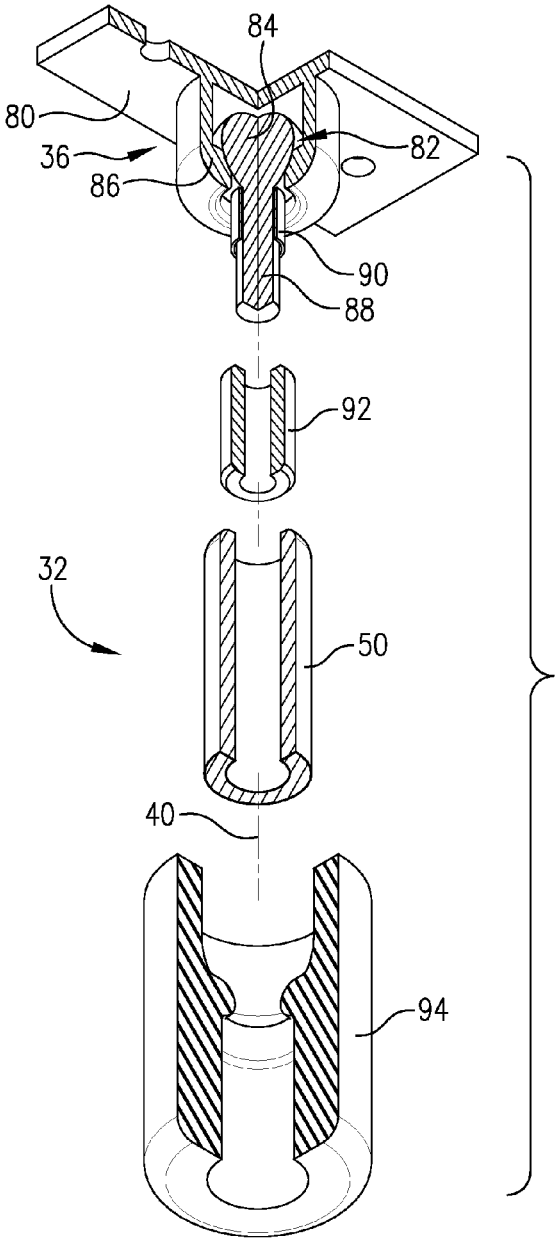
Figure 5B:
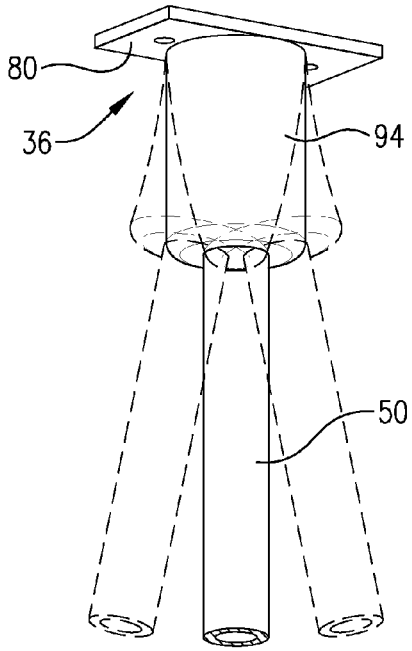
Figure 6:
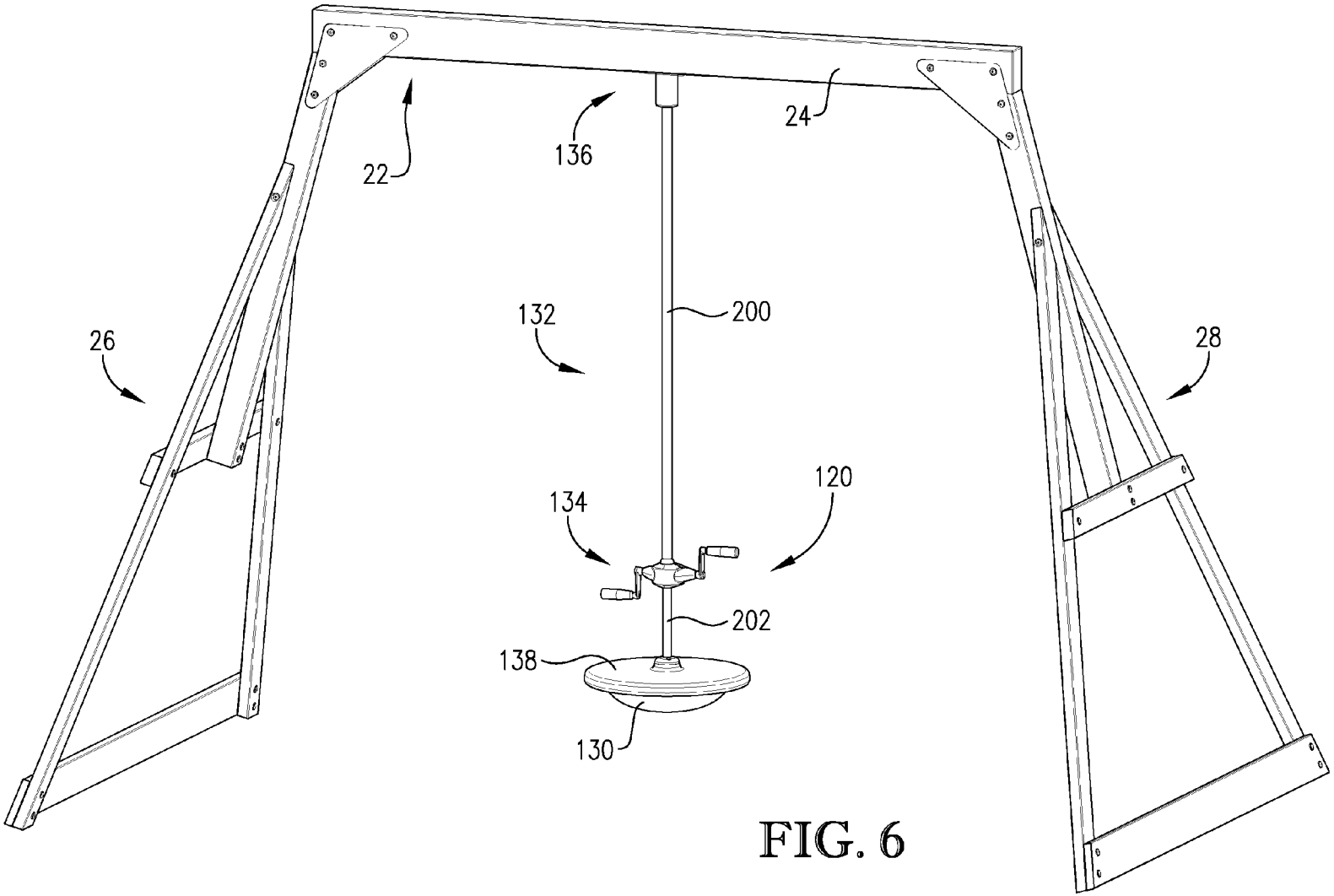
Figure 7:
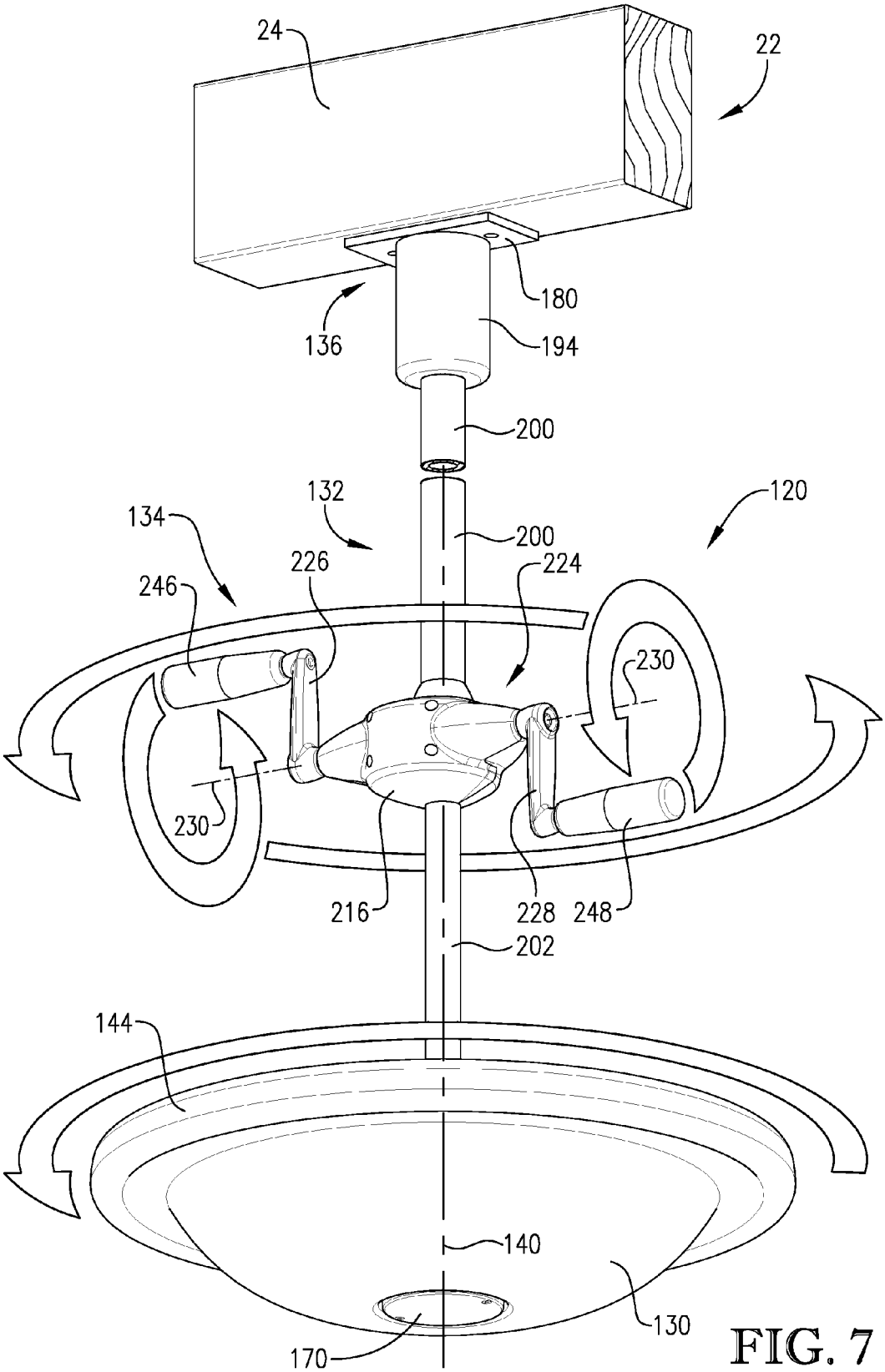
Figure 8:
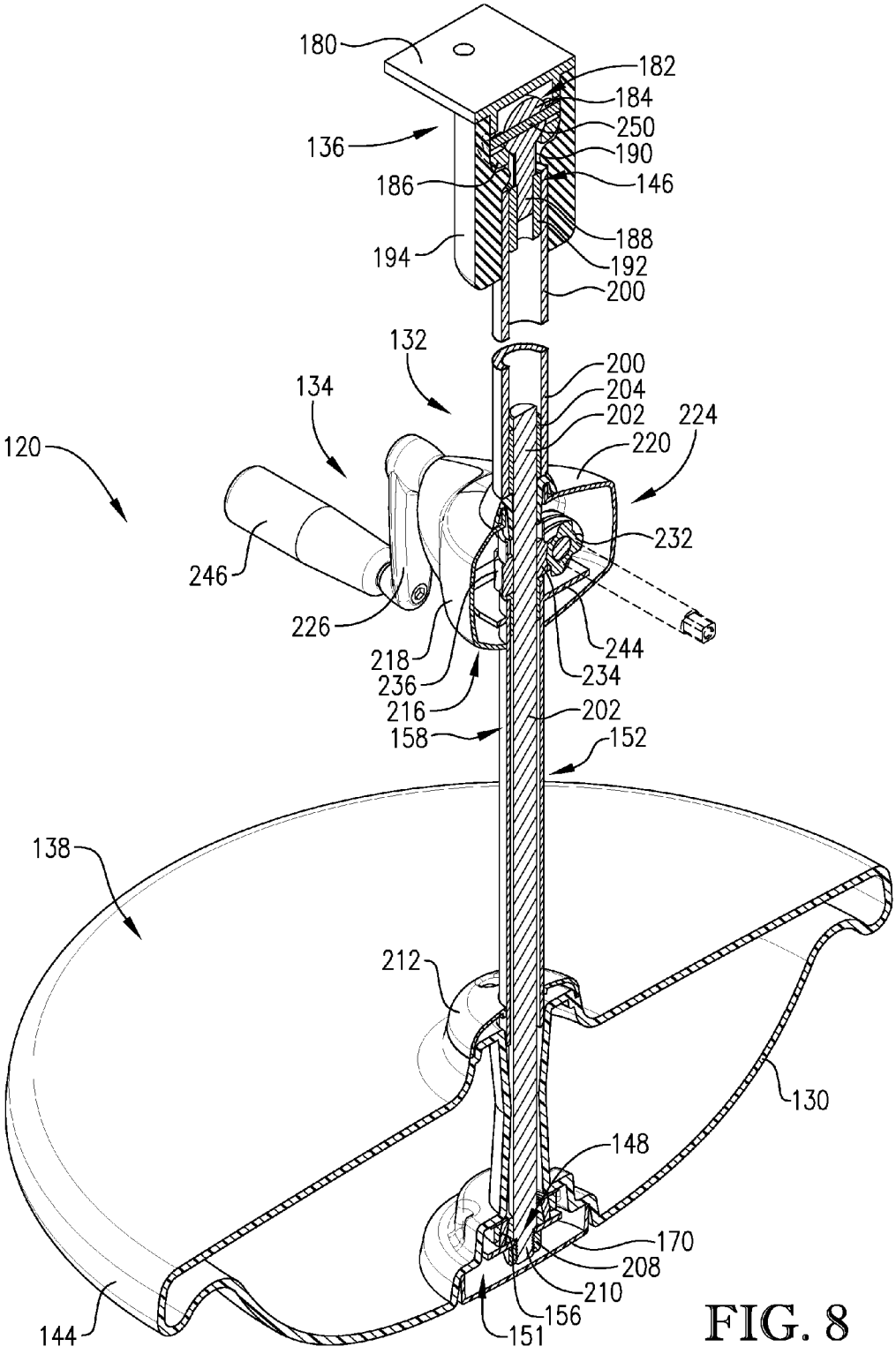
Figure 9:
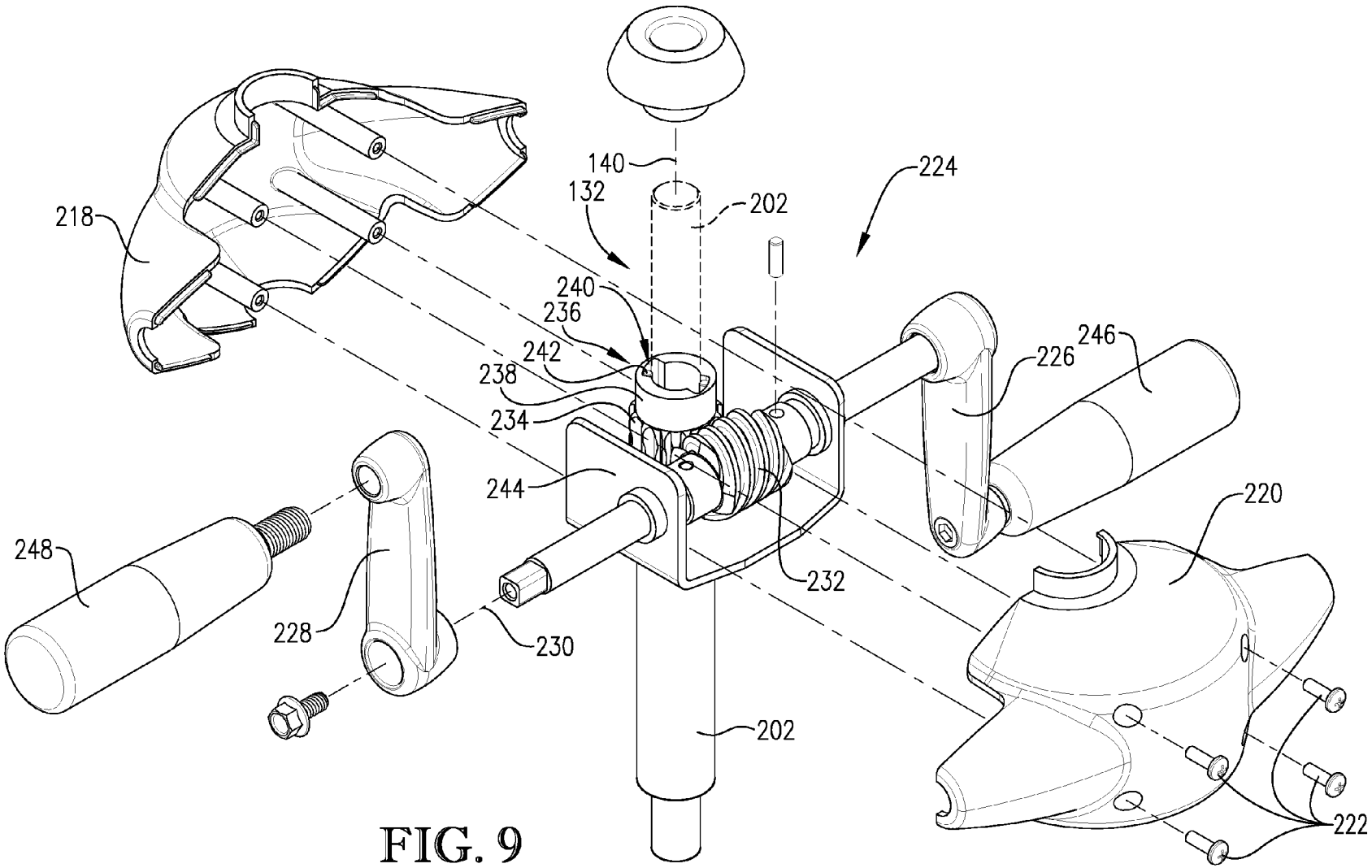
Figure 10:
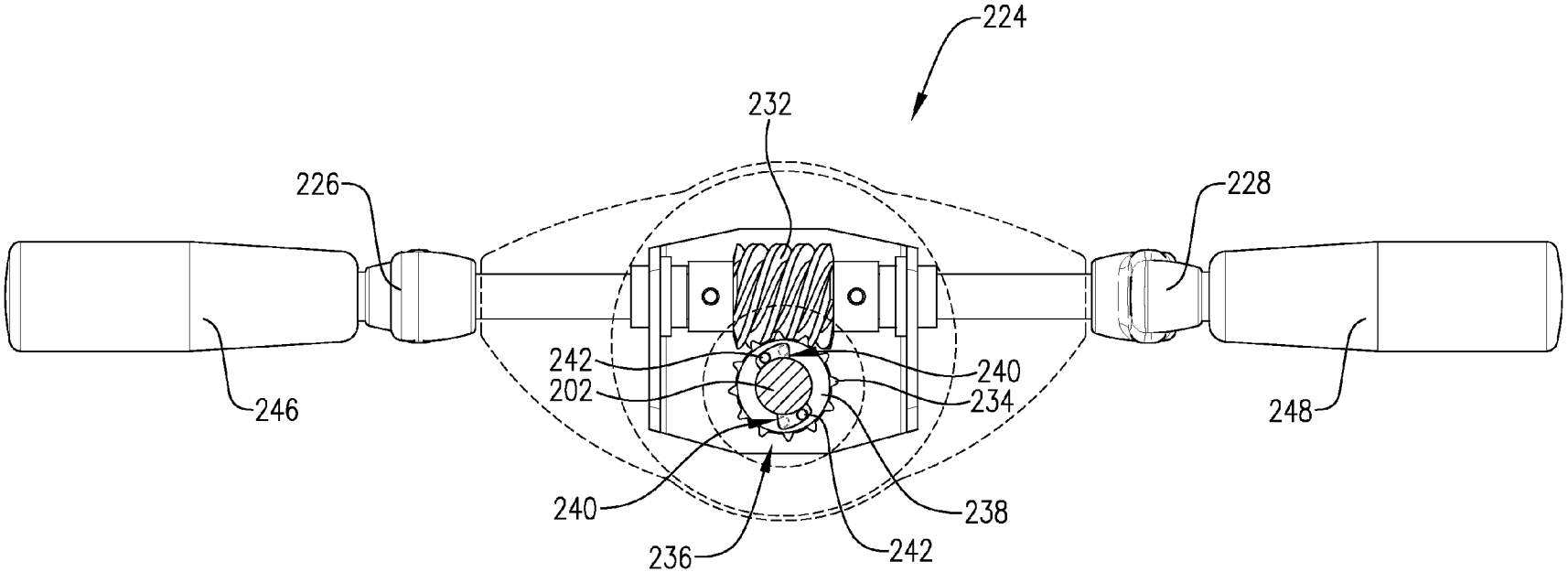
Figure 11:
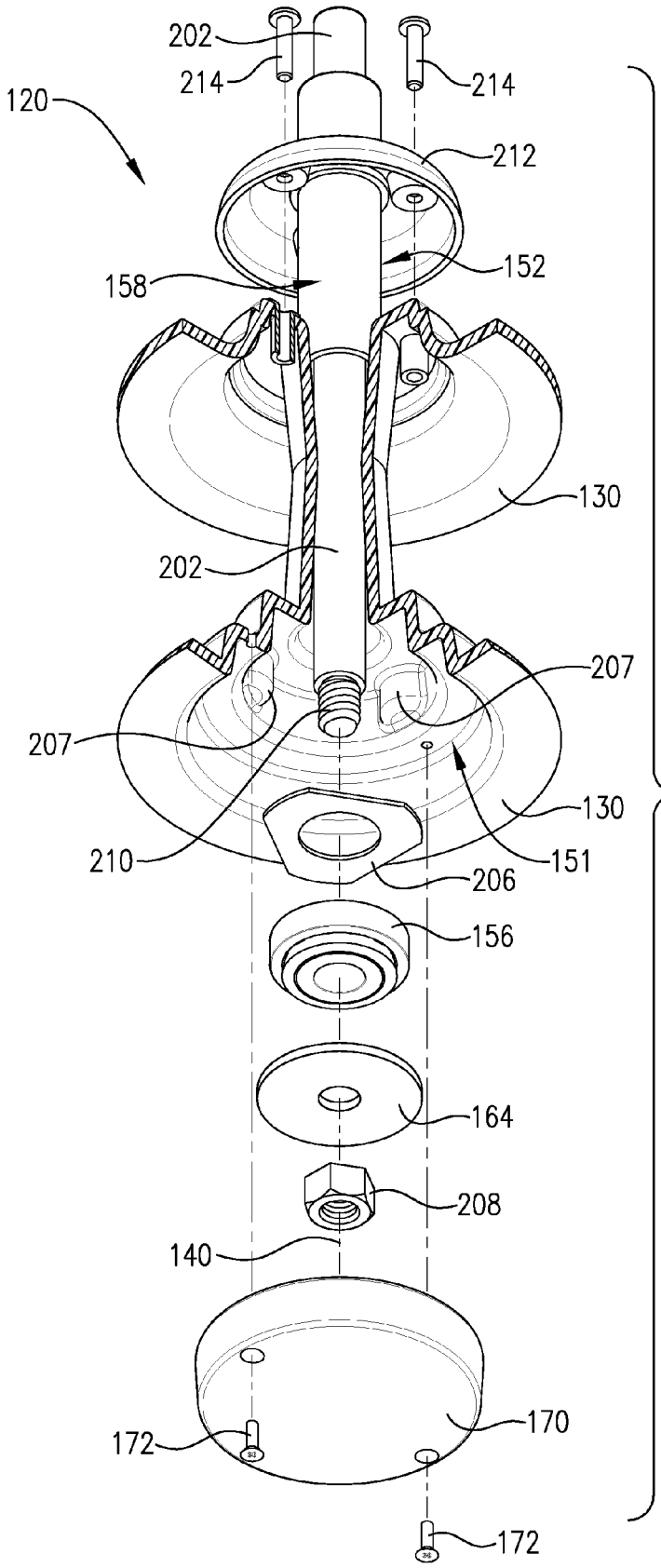
Figure 12:
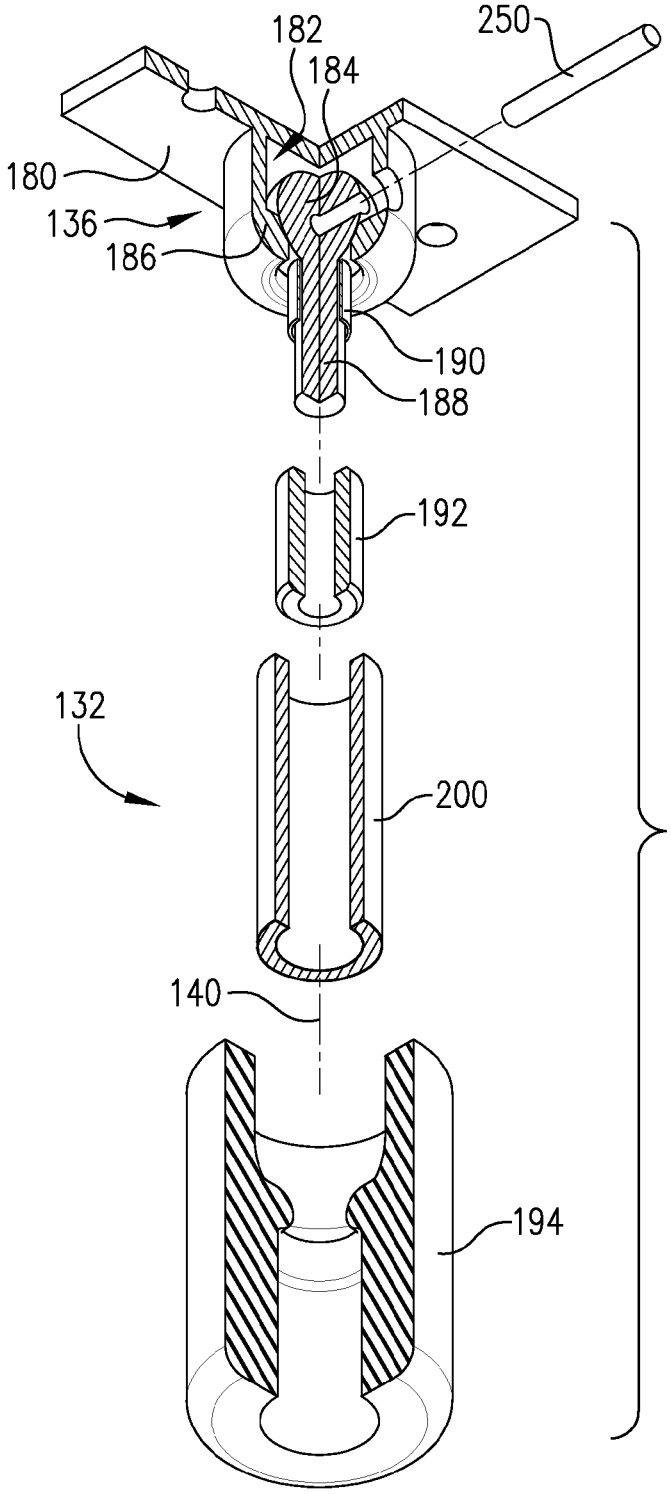

FIG. 3 is an enlarged, partial fragmentary, generally isometric, partial sectional view of the rotating seat shown in FIGS. 1-2, particularly illustrating internal details of construction of the suspending element being coupled with the seat body and with the fixed handle assembly, as well as internal details of construction of a damped pivot connection assembly for connecting the suspending element to the play set structure;

FIG. 4 is an enlarged, exploded, partial sectional view of a portion of the rotating seat shown in FIGS. 1-3, particularly illustrating components involved in the coupling of the suspending element with the seat body;

FIG. 5*a* is an enlarged, exploded, partial sectional view of a portion of the rotating seat shown in FIGS. 1-3, particularly illustrating components involved in the damped pivot connection assembly for connecting the suspending element to the play set structure;

FIG. 5*b* is an isometric view the portion of the rotating seat shown in FIG. 5*a*, particularly illustrating the damped pivot connection assembly for connecting the suspending element to the play set structure, with multiple pivoted dispositions being shown in phantom lines;

FIG. 6 is an isometric view of a rotating seat constructed in accordance with the principles of another embodiment of the present invention including a rotatable seat body and a handle assembly rotatable relative to a suspending element, the rotating seat shown with and secured to a typical play set structure;

FIG. 7 is an enlarged, partial fragmentary, isometric view of the rotating seat shown in FIG. 6, particularly illustrating the rotating motion of the seat body and the rotatable handle assembly relative to a generally vertical axis of rotation and the rotating motion of a crank mechanism of the handle assembly relative to a horizontal crank axis being rotated in a first crank direction;

FIG. 8 is an enlarged, partial fragmentary, generally isometric, partial sectional view of the rotating seat shown in FIGS. 6-7, particularly illustrating internal details of construction of the suspending element being coupled with the seat body and with the rotatable handle assembly, including internal details of construction of the crank mechanism as well as internal details of construction of a damped pivot connection assembly for connecting the suspending element to the play set structure;

FIG. 9 is an enlarged, exploded, isometric view of a portion of the rotating seat shown in FIGS. 6-8, particularly illustrating components of the crank mechanism of the rotatable handle assembly and a portion of the suspending element;

FIG. 10 is an enlarged, top-down plan view of the portion of the rotating seat shown in FIG. 9, particularly illustrating internal details of construction of the crank mechanism and of a one-way clutch device associated with the connection between the rotatable handle assembly and the suspending element;

FIG. 11 is an enlarged, partial fragmentary, exploded, partial sectional view of a portion of the rotating seat shown in FIGS. 6-8, particularly illustrating components involved in the coupling of a portion of the suspending element with the seat body; and FIG. 12 is an enlarged, exploded, partial sectional view of a portion of the rotating seat shown in FIGS. 6-8, particularly illustrating components involved in the damped pivot connection assembly for connecting the suspending element to the play set structure.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

With initial reference to FIGS. 1-5, a rotating seat 20 constructed in accordance with the principles of an embodiment of the present invention is shown with and suspended from a play set structure 22. The play set structure 22 is generally conventional, and specifically includes a cross member 24 secured to and elevated above the ground by a pair of side support components 26, 28. As is customary, traditional hardware is used to secure the various play set structure components to one another. The elements of the play set structure 22 are typically made of wood, although it will be readily appreciated by one of ordinary skill in the art that other suitable materials could also be used.

Additionally, while the illustrated play set structure 22 supports only the suspended rotating seat 20 described in detail herein, it will be readily appreciated that a number of known play accessories (e.g., swings, slides, climbing walls, etc.) may also be included with alternatively constructed play set structure (not shown). Furthermore, the rotating seat 20 may also be suspended from suitable structure other than the conventional play set structure 22 (such as from joists on the underneath side of a suspended deck; not shown) without departing from the teachings of the present invention.

With continued reference particularly to FIGS. 1-3, the rotating seat 20 broadly includes a seat body 30, an elongated suspending element 32 configured to support the seat body 30 from the play set structure 22, and a handle assembly 34 operably coupled with the suspending element 32. The illustrated rotating seat 20 further includes a pivot connection assembly 36 operably securing the suspending element 32 with the cross member 24 of the play set structure 22. It is noted, of course, that it may also be possible to secure the suspending element 32 with the play set structure 22 (or other structure) with an alternative suitable connection assembly (not shown) without departing from the teachings of the present invention.

With attention still on FIGS. 1-3, the seat body 30 will be described in further detail. The seat body 30 includes an upper seating surface 38 that is configured to support a user of the rotating seat, such as a child. The seat body 30 is freely rotatable about a generally vertical axis of rotation 40 (see FIG. 2), as is generally indicated by the arrow shown in FIG. 2. In the illustrated embodiment, the suspending element 32 defines the axis of rotation 40 of the seat body 30. Thus, the seat body 30 is freely rotatable relative to the suspending element 32, with the seat body 30 being operably coupled with the suspending element 32 through a low friction bearing mechanism 42, as shown particularly in FIGS. 3-4 and described in detail below.

Returning now to structural details of the depicted seat body 30, the seat body 30 is unitarily molded from a synthetic resin material to present a substantially circular outer circumferential periphery 44. In one embodiment, the seat body 30 is substantially hollow and may be formed of blow-molded plastic. The illustrated seat body 30 is generally annular in shape and is devoid of any sharp corners about the outer circumferential periphery 44 thereof. As shown, the upper seating surface 38 of the seat body 30 is substantially flat, such that a user may comfortably sit anywhere along the seating surface 38.

Returning briefly now to FIGS. 1-3, the elongated suspending element 32 will be described in further detail. The suspending element 32 extends substantially vertically and presents an upper end margin 46 and an opposite lower end margin 48. The suspending element 32 is configured to operably couple with the play set structure 22 along the upper end margin 46 thereof (for example, along the cross member 24). The suspending element 32 is also configured to be operably coupled with the seat body 30 at a location spaced from the upper end margin 46.

In the embodiment shown, the suspending element 32 is configured such that the lower end margin 48 thereof is spaced from the ground. In more detail, the seat body 30 of the illustrated embodiment is operably coupled with the suspending element 32 through the low friction bearing mechanism 42 along the lower end margin 48 of the suspending element 32 for relative rotation thereabout. In this way, the seat body 30 of the rotating seat 20 is disposed above the surface of the ground, as will be readily appreciated by one of ordinary skill in the art.

In more detail, the suspending element 32 shown in FIGS. 1-5 is at least substantially rigid. In even more detail, the illustrated suspending element 32 of FIGS. 1-5 consists of a single generally tubular metal body 50 extending substantially continuously between the upper end margin 46 and the lower end margin 48. If desired, the specific construction of the depicted suspending element 32 described in detail herein may be varied without departing from the spirit of the present invention.

Turning specifically now to FIGS. 3-4, details of an embodiment of the low friction bearing mechanism 42 will be described in further detail. The bearing mechanism 42 is generally disposed within an axial recess 51 defined by the seat body 30. The bearing mechanism 42 and broadly includes a protective outer sleeve element 52, an upper bearing 54, and a lower bearing 56. The outer sleeve element 52 comprises an upper tubular portion 58 and a lower flange portion 60, with the lower flange portion 60 extending radially outwardly from the upper tubular portion 58. The outer sleeve element 52 is disposed generally coaxially about at least a portion of the suspending element 32. The upper tubular portion 58 extends axially at least substantially between the upper seating surface 38 of the seat body 30 and the handle assembly 34.

The upper bearing 54 is disposed radially between the suspending element 32 and the outer sleeve element 52 along an upper margin of the tubular portion 58 of the outer sleeve element 52 to provide low friction relative rotation therebetween. The outer sleeve element 52 is coupled with and rotationally fixed relative to the seat body 30. Fasteners in the form of screws 62 pass through the flange portion 60 of the outer sleeve element 52 and into corresponding locations within the seat body 30. In this way, the seat body 30 and the protective outer sleeve element 52 are rotationally fixed relative to one another and therefore rotate together about the suspending element 32 (see FIG. 3).

A washer 64 is axially fixed to the lower end margin 48 of the suspending element 32. In the illustrated embodiment, a bolt 66 secures the washer 64 to the lower end margin 48 of the suspending element 32 via an adapter sleeve 68, as will be readily appreciated by one of ordinary skill in the art upon review of this disclosure. The lower bearing 56 is disposed axially between the flange portion 60 of the outer sleeve element 52 (which is rotationally fixed relative to the seat body 30) and the washer 64 (which is axially fixed relative to the suspending element 32). In this way, the seat body 30 is configured to rotate freely relative to the suspending element 32.

An end cap 70 is secured to the flange portion 60 of the outer sleeve element 52 (which is rotationally fixed relative to the seat body 30) with fasteners in the form of screws 72 to cover the axial recess 51. In this way, the rotatable interconnection between the seat body 30 and the suspending element 32 is covered so as to be protected from the elements and to provide a safeguard against injury to the user.

It will be readily appreciated by one of ordinary skill in the art that the rotational connection between the seat body 30 and the suspending element 32 depicted and described in detail herein may be varied without departing from the spirit of the present invention. For example, the bearing mechanism design may be changed, or other suitable means may be provided for rotatably coupling these components, while remaining within the ambit of the present invention.

Returning briefly now to FIGS. 1-3, the handle assembly 34 will be described in further detail. The handle assembly 34 is spaced above the seat body 30, with the outer sleeve element 52 extending axially at least substantially between the upper seating surface 38 of the seat body 30 and the handle assembly 34. In an alternative embodiment (not shown), the spacing of the handle assembly 34 above the seat body 30 may be adjustable, with such a feature remaining firmly within the ambit of the present invention.

In the embodiment depicted in FIGS. 1-5, the handle assembly 34 is rotationally fixed relative to the suspending element 32. In more detail, the illustrated handle assembly 34 comprises a unitary handle body 74 and a pin 76 extending generally horizontally through at least portions of both the handle body 74 and the suspending element 32. In this way, relative rotation and axial movement between the handle body 74 and the suspending element 32 is restricted.

In even more detail, the handle body 74 is unitarily molded from a synthetic resin material to present a substantially circular outer circumferential periphery 78. The illustrated handle body 74 is generally annular in shape and is devoid of any sharp corners about the outer circumferential periphery 78 thereof. As shown, the diameter of the handle body 74 is smaller than the diameter of the seat body 30.

During operation of the rotating seat 20 shown in FIGS. 1-5, a user may sit on the seating surface 38 of the seat body 30 and grasp the handle body 74 to pull or push against the fixed handle assembly 34. Pulling or pushing against the fixed handle assembly 34 causes the seat body 30 to rotate relative to the suspending element 32 in either a clockwise or counterclockwise direction. The user can continuously advance his or her hands in a given direction in order to maintain rotation or increase rotational speed, as will be readily appreciated by one of ordinary skill in the art. Since the seat body 30 rotates freely relative to the suspending element 32 as described above, it is noted that the user can generate rotational speed by pulling or pushing against the fixed handle assembly 34 and then release the handle assembly 34 while continuing to rotate.

Turning specifically now to FIGS. 3, 5*a*, and 5*b*, construction details of an embodiment of the pivot connection assembly 36 will be described in further detail. The pivot connection assembly 36 is configured to operably secure the upper end margin 46 of the suspending element 32 with the play set structure 22. The pivot connection assembly 36 includes a fixed bracket 80 for attaching to the play set structure 22 while allowing generally pivotal movement of the suspending element 32 about at least one substantially horizontal axis (not shown) defined through the pivot connection assembly.

In one embodiment, the pivot connection assembly 36 includes a ball joint 82 including a ball 84 fixed relative to the suspending element 32. The ball 84 is disposed within a socket 86 fixed relative to the bracket 80 (as depicted, the socket 86 and the bracket 80 are formed as a single piece). In the illustrated embodiment, the ball 84 includes an axial projection 88 protruding out from the socket 86. The axial projection 88 of the ball 84 includes a protective sleeve 90 disposed around at least a portion thereof, with the axial projection 88 being secured to the upper end margin 46 of the suspending element 32 via an adapter sleeve 92, as will be readily appreciated by one of ordinary skill in the art upon review of this disclosure.

The pivot connection assembly 36 further includes a damping element preferably in the form of an elastomeric sleeve 94 operable to restrain pivoting movement of the suspending element 32 relative to the fixed bracket 80 due to lateral forces applied to either the suspending element 32, the seat body 30, or the combination thereof. In one embodiment, the elastomeric sleeve 94 is disposed around at least a part of the ball joint 82. In more detail, the illustrated embodiment includes the elastomeric sleeve 94 being disposed around at least a portion of the socket 86 and around at least a portion of the upper end margin 46 of the suspending element 32 (see FIG. 3).

It will be readily appreciated by one of ordinary skill in the art that, if desired, the specific construction of the depicted elastomeric sleeve 94 described in detail herein may be varied without departing from the spirit of the present invention. For example, the damping element design may be changed, such as being disposed only around the axial projection of the ball 84 and being configured to restrain pivoting movement by working against a portion of the socket, while remaining within the ambit of the present invention.

As shown in the phantom lines of FIG. 5*b*, the pivot connection assembly 36, which includes the damping element in the form of the elastomeric sleeve 94, allows some restrained generally pivotal movement of the suspending element 32 relative to the fixed bracket 80. It is believed that the damped pivot connection assembly 36 may prevent bending or other damage to the rigid suspending element 32 during repeated use of the rotating seat 20.

With reference now to FIGS. 6-12, a rotating seat 120 constructed in accordance with the principles of another embodiment of the present invention is shown with and suspended from the play set structure 22. The mounting and supporting aspects of suspending the rotating seat 120 shown in FIGS. 6-12 to the play set structure 22, or to alternative structures (not shown), is substantially the same as described above with respect to the rotating seat 20 shown in FIGS. 1-5 discussed above. Therefore, for the sake of brevity, additional description of the play set structure 22 or alternative structures (not shown) that may support the suspended rotating seat 120 will be avoided.

With continued reference particularly to FIGS. 6-8, the rotating seat 120 broadly includes a seat body 130, an elongated suspending element 132 configured to support the seat body 130 from the play set structure 22, and a handle assembly 134 operably coupled with the suspending element 132. The illustrated rotating seat 120 further includes a pivot connection assembly 136 operably securing the suspending element 132 with the cross member 24 of the play set structure 22.

One of ordinary skill in the art will readily appreciate that many of the components of the rotating seat 120 shown in FIGS. 6-12 are similar in many respects to corresponding components of the rotating seat 20 shown in FIGS. 1-5 discussed above, with the main differences involving the nature of the handle assembly 134 and construction details of the suspending element 132. Therefore, corresponding or similar components are similarly numbered herein (incremented by an order of one hundred) as described above, and new or different components unique to the rotating seat 120 are numbered starting at two hundred.

For the sake of brevity, the description of the embodiment of the rotating seat 120 will focus on distinctions between components (e.g., the nature of a preferred embodiment of the handle assembly 134 and construction details of the suspending element 132), with an understanding of the corresponding or similar components being readily apparent to one of ordinary skill in the art from the descriptions above.

With attention still on FIGS. 6-8, the seat body 130 will be briefly described in further detail. The seat body 130 includes an upper seating surface 138 that is configured to support a user and is freely rotatable about a generally vertical axis of rotation 140 (see FIG. 7), as is generally indicated by the arrow shown in FIG. 7. In the illustrated embodiment, the suspending element 132 defines the axis of rotation 140 of the seat body 130. Thus, the seat body 130 is freely rotatable relative to the suspending element 132, with the seat body 130 being operably coupled with the suspending element 132 through a low friction bearing mechanism 142, as shown particularly in FIGS. 8 and 11 and described in detail below.

Returning briefly now to FIGS. 6-8, the elongated suspending element 132 will be briefly described in further detail. The suspending element 132 extends substantially vertically and presents an upper end margin 146 and an opposite lower end margin 148. The suspending element 132 is configured to operably couple with the play set structure 22 along the upper end margin 146 thereof. The suspending element 132 is also configured to be operably coupled with the seat body 130 at a location spaced from the upper end margin 146.

In the embodiment shown, the suspending element 132 is configured such that the lower end margin 148 thereof is spaced from the ground. In more detail, the seat body 130 of the illustrated embodiment is rotatably coupled with the suspending element 132 through the low friction bearing mechanism 142 along the lower end margin 148 of the suspending element 132. In this way, the seat body 130 of the rotating seat 120 is disposed above the surface of the ground.

In more detail, the suspending element 132 shown in FIGS. 6-12 is at least substantially rigid. In even more detail, the illustrated suspending element 132 of FIGS. 6-12 comprises a first generally tubular metal body 200 and a second metal body 202 at least partly coaxially received within the first metal body 200. While the coaxially intercoupled construction of the bodies 200 and 202 is depicted in a preferred embodiment, this construction detail is not necessarily required to remain within the spirit of the invention.

The first metal body 200 and the second metal body 202 are operably secured to one another via an adapter sleeve 204, as will be readily appreciated by one of ordinary skill in the art upon review of this disclosure. The secured combination of the first metal body 200 and the second metal body 202 collectively extends substantially continuously between the upper end margin 146 and the lower end margin 148 of the suspending element 132.

As shown particularly in FIG. 8, the first metal body 200 is disposed above the handle assembly 134 and includes the upper end margin 146 of the suspending element 132. The second metal body 202 extends below the first metal body 200 and defines a portion of the suspending element 132 about which the handle assembly 134 is disposed. The second metal body 202 also includes the lower end margin 148 of the suspending element 132, which is spaced from the ground.

Turning specifically now to FIGS. 8 and 11, construction details of an embodiment of the low friction bearing mechanism 142 including a lower bearing 156 will be described in further detail. The bearing mechanism 142 is generally disposed within an axial recess 151 defined by the seat body 130. A first triangular washer 206 is received within the axial recess 151 and is spaced from the lower end margin 148 of the second metal body 202. The triangular washer 206 is rotationally fixed relative to the seat body 130 because the triangular shape of the first washer 206 preferably fits within a space defined by three corresponding protrusions 207 of the seat body 130 extending into the axial recess 151 (see FIG. 11).

A second washer 164 is axially fixed to the lower end margin 148 of the second metal body 202. In the illustrated embodiment, a nut 208 secures the washer 164 to a threaded portion 210 of the lower end margin 148 of the second metal body 202, as will be readily appreciated by one of ordinary skill in the art upon review of this disclosure. The lower bearing 156 is disposed axially between the first triangular washer 206 (which is rotationally fixed relative to the seat body 130) and the second washer 164 (which is axially fixed relative to the suspending element 132). In this way, the seat body 130 is configured to rotate freely relative to the suspending element 132.

A bottom end cap 170 is secured to the seat body 130 with fasteners in the form of screws 172 to cover the axial recess 151. Additionally, a top end cap 212 is secured to the seat body 130 with fasteners in the form of screws 214 (see FIG. 11). In this way, the rotatable interconnection between the seat body 130 and the suspending element 132 is covered so as to be protected from the elements and to provide a safeguard against injury to the user.

Returning briefly now to FIGS. 6-8, and with attention also to FIGS. 9-10, a preferred embodiment of the unique handle assembly 134 of the rotating seat 120 will be described in further detail. The handle assembly 134 is spaced above the seat body 130. A protective outer sleeve element 152 extends axially at least substantially between the upper seating surface 138 of the seat body 130 and the handle assembly 134.

In the embodiment depicted in FIGS. 6-12, the handle assembly 134 is rotatable relative to the suspending element 132 about the vertical axis of rotation 140. In more detail, the illustrated handle assembly 134 broadly comprises a handle body 216 (formed of corresponding halves 218, 220 secured to one another with fasteners in the form of screws 222; see FIG. 9) and a crank mechanism 224. The crank mechanism 224 includes a pair of coaxial crank arms 226, 228 rotatable about a horizontal crank axis 230. The crank mechanism 224 is configured such that the handle assembly 134 rotates about the suspending element 132 as the crank arms 226, 228 are rotated in a first crank direction.

In even more detail, with attention particularly to FIGS. 9-10, the crank mechanism 224 also includes a worm gear 232 rotatable about the crank axis 230. The handle assembly 134 includes a spur gear 234 disposed coaxially about the suspending element 132. The spur gear 234 is operably intermeshed with the worm gear 232 such that the spur gear 234 rotates about the suspending element 132 as the crank arms 226, 228 are rotated in the first crank direction.

In the illustrated embodiment, the handle assembly 134 further includes a one-way clutch device 236. The one-way clutch device 236 is configured to engage with the suspending element 132 and thereby cause rotation of the handle assembly 134 thereabout upon rotation of the crank arms 226, 228 in the first crank direction. In addition, the one-way clutch device 236 is further configured to disengage from the suspending element 132 and thereby provide "freewheel" rotation of the crank mechanism 224 when the crank arms 226, 228 are rotated in a second crank direction opposite the first crank direction. Thus, rotation of the crank arms 226, 228 in the second crank direction simply freewheels the crank mechanism 224 without causing rotation of the handle assembly 134 about the suspending element 132.

It will be readily appreciated by one of ordinary skill in the art that, if desired, the specific construction details of the depicted crank mechanism 224 described in detail herein may be varied without departing from the spirit of the present invention. For example, the depicted gear configurations may be altered, or the freewheel feature provided by the one-way clutch device 236 may be changed or removed (e.g., such that an alternatively constructed crank mechanism may cause rotation of the handle assembly about the suspending element upon rotation of the crank in either direction). These illustrative types of incidental design changes are contemplated herein and would of course remain fully within the ambit of the present invention.

In even more detail, the depicted one-way clutch device 236 includes a generally annular body 238 with a pair of angularly eccentric slots 240 and pins 242 received within the eccentric slots 240. The annular clutch body 238 is secured to and configured to rotate with the spur gear 234. Therefore, as shown particularly in FIG. 10, when the crank arms 226, 228 are rotated in a first crank direction, the worm gear 232 causes the spur gear 234 (and consequently the annular clutch body 238) to rotate in a first direction (clockwise in the perspective of FIG. 10). This rotation of the annular clutch body 238 causes the pins 242 to move into the narrow portions of the eccentric slots 240 and thereby clamp down on the second metal body 202 of the suspending element, thereby causing the handle assembly 134 to rotate relative to the suspending element 132.

Additionally, it is noted that the protective outer sleeve element 152 comprises a lower tubular portion 158 and a supporting structure portion 244 for the crank mechanism 224. The outer sleeve element 152 is disposed generally coaxially about at least a portion of the suspending element 132, with the lower tubular portion 158 extending axially at least substantially between the upper seating surface 138 of the seat body 130 and the rotatable handle assembly 134. In this way, the rotatable handle assembly 134 and the protective outer sleeve element 152 are rotationally fixed relative to one another and therefore rotate together about the suspending element 132 (see FIG. 8).

During operation of the rotating seat 120 shown in FIGS. 6-12, a user may sit on the seating surface 138 of the seat body 130 and grasp crank handles 246, 248 of the rotatable handle assembly 134 to rotate the crank mechanism 224 in the first crank direction. Rotating the crank mechanism 224 in the first crank direction causes the handle assembly 134 (and thereby the seat body 130 due to the presence of the user) to rotate relative to the suspending element 132. As described above, rotating the crank mechanism 224 in a second crank direction opposite the first crank direction would simply freewheel the crank mechanism 224 without causing rotation of the handle assembly 134 about the suspending element 132 (due to the freewheel feature preferably provided by the one-way clutch device 236).

As will be readily appreciated, the user can continue to rotate the crank mechanism 224 in the first crank direction in order to maintain rotation or increase rotational speed, as will be readily appreciated by one of ordinary skill in the art. Since the seat body 130 rotates freely relative to the suspending element 132 as described above (and the crank mechanism 224 is designed to freewheel), it is noted that the user can generate rotational speed by rotating the crank mechanism 224 in the first crank direction and then stop rotating the crank mechanism 224 while continuing to rotate.

Turning specifically now to FIG. 12, construction details of an embodiment of the pivot connection assembly 136 will be briefly described in further detail. The pivot connection assembly 136 is configured to operably secure the upper end margin 146 of the first metal body 200 of the suspending element 132 with the play set structure 22. The pivot connection assembly 136 is substantially similar in virtually all respects to the pivot connection assembly 36 shown in FIGS. 3, 5*a*, and 5*b*, and described in detail above (and therefore will not be described in detail again here), but for being restricted to pivoting movement about a single horizontal axis. In particular, an extra pin 250 is provided for restricting pivoting movement in this manner.

In more detail, the pivot connection assembly 136 shown in FIG. 12 includes the extra pin 250 extending generally horizontally through at least portions of both the ball 184 and the socket 186 to restrict the generally pivotal movement of the suspending element 132 to only one substantially horizontal second axis defined through the pivot connection assembly 136. As will be readily understood by one of ordinary skill in the art upon review of this disclosure, the inclusion of the extra pin 250 may be incorporated into the pivot connection assembly 36 shown in FIGS. 3, 5*a*, and 5*b* (or conversely omitted from the pivot connection assembly 136 shown in FIG. 12) without departing from the teachings of the present invention.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and access the reasonably fair scope of the present invention as pertains to any apparatus not materially departing from but outside the literal scope of the invention set forth in the following claims.

What is claimed is:

1. A rotating seat for suspension from a play set structure, said rotating seat comprising:

a seat body including an upper seating surface configured to support a user, said seat body being rotatable about a generally vertical axis of rotation;

an elongated suspending element configured to support the seat body from the play set structure, said suspending element extending substantially vertically and presenting opposite upper and lower end margins, said suspending element being configured to operably couple with the play set structure along the upper end margin, and being operably coupled with the seat body at a location spaced from the upper end margin; and a handle assembly operably coupled with the suspending element and configured to cause rotation of the seat body relative to the axis upon actuation thereof, said suspending element defining the axis of rotation for the seat body, said seat body being rotatable relative to the suspending element, said suspending element being operably coupled with the seat body along the lower end margin of the suspending element for relative rotation thereabout.

2. The rotating seat as claimed in claim 1, said seat body being unitarily molded from a synthetic resin material to present a substantially circular outer circumferential periphery, said seat body being generally annular and devoid of sharp corners about the outer circumferential periphery thereof.

3. A rotating seat for suspension from a play set structure, said rotating seat comprising:

a seat body including an upper seating surface configured to support a user, said seat body being rotatable about a generally vertical axis of rotation;

an elongated suspending element configured to support the seat body from the play set structure, said suspending element extending substantially vertically and presenting opposite upper and lower end margins, said suspending element being configured to operably couple with the play set structure along the upper end margin, and being operably coupled with the seat body at a location spaced from the upper end margin;

a handle assembly operably coupled with the suspending element and configured to cause rotation of the seat body relative to the axis upon actuation thereof, said suspending element being at least substantially rigid; and a pivot connection assembly configured to operably secure the upper end margin of the suspending element with the play set structure, said pivot connection assembly including a fixed bracket for attaching to the play set structure while allowing generally pivotal movement of the suspending element about at least one substantially horizontal axis defined through the pivot connection assembly.

4. The rotating seat as claimed in claim 3, said pivot connection assembly further including a damping element operable to restrain pivoting movement of the suspending element relative to the fixed bracket due to lateral forces applied to either the suspending element, the seat body, or the combination thereof.

5. The rotating seat as claimed in claim 4, said pivot connection assembly comprising a ball joint including a ball fixed relative to the suspending element and a socket fixed relative to the bracket.

6. The rotating seat as claimed in claim 5, said pivot connection assembly further comprising a pin extending generally horizontally through at least portions of both the ball and the socket to restrict the generally pivotal movement of the suspending element to only one substantially horizontal second axis defined through the pivot connection assembly.

7. The rotating seat as claimed in claim 5, said damping element comprising an elastomeric sleeve disposed around at least a part of the ball joint.

8. The rotating seat as claimed in claim 7, said elastomeric sleeve being disposed around at least a portion of the socket and around at least a portion of the upper end margin of the suspending element.

9. A rotating seat for suspension from a play set structure, said rotating seat comprising:

a seat body including an upper seating surface configured to support a user, said seat body being rotatable about a generally vertical axis of rotation;

an elongated suspending element configured to support the seat body from the play set structure, said suspending element extending substantially vertically and presenting opposite upper and lower end margins, said suspending element being configured to operably couple with the play set structure along the upper end margin, and being operably coupled with the seat body at a location spaced from the upper end margin;

a handle assembly operably coupled with the suspending element and configured to cause rotation of the seat body relative to the axis upon actuation thereof, said handle assembly being spaced above the seat body; and a protective sleeve disposed coaxially about the suspending element and extending axially at least substantially between the upper seating surface of the seat body and the handle assembly.

10. The rotating seat as claimed in claim 9, said handle assembly being rotationally fixed relative to the suspending element.

11. The rotating seat as claimed in claim 10, said handle assembly comprising a unitary handle body, said handle assembly further comprising a pin extending generally horizontally through at least portions of both the handle body and the suspending element to restrict relative rotation and axial movement therebetween.

12. The rotating seat as claimed in claim 11, said seat body being unitarily molded from a synthetic resin material, said seat body and said handle body each presenting a respective substantially circular outer periphery, with the diameter of the handle body being smaller than the diameter of the seat body.

13. The rotating seat as claimed in claim 9, said suspending element defining the axis of rotation for the seat body, said handle assembly being rotatable relative to the suspending element about the vertical axis of rotation.

14. The rotating seat as claimed in claim 13, said handle assembly including a crank mechanism with at least one crank arm rotatable about a horizontal crank axis, said crank mechanism being configured such that the handle assembly rotates about the suspending element as the crank arm is rotated in a first crank direction.

15. The rotating seat as claimed in claim 14, said crank mechanism including a pair of coaxial crank arms and a worm gear rotatable about the crank axis, said handle assembly including a spur gear disposed coaxially about the suspending element and being operably intermeshed with the worm gear such that the spur gear rotates about the suspending element as the crank arms are rotated in the first crank direction.

16. The rotating seat as claimed in claim 15, said handle assembly further including a one-way clutch device, said one-way clutch device being configured to engage with the suspending element and thereby cause rotation of the handle assembly thereabout upon rotation of the crank arms in the first crank direction, said one-way clutch device being further configured to disengage from the suspending element and thereby provide freewheel rotation of the crank arms without causing rotation of the handle assembly thereabout upon rotation of the crank arms in a second crank direction opposite the first crank direction.

17. The rotating seat as claimed in claim 16, said suspending element comprising a first generally tubular metal body and a second metal body at least partly coaxially received within the first metal body, said first metal body being disposed above the handle assembly and including the upper end margin of the suspending element, said second metal body extending below the first metal body, defining a portion of the suspending element about which the handle assembly is rotatable, and including the lower end margin of the suspending element, which is spaced from the ground.

* * * * *